US006450526B1

(12) United States Patent
Bressand

(10) Patent No.: US 6,450,526 B1
(45) Date of Patent: Sep. 17, 2002

(54) SUSPENDED HEEL-PIECE FOR THE SAFETY BINDING OF A SKI

(75) Inventor: René Bressand, Saint-Jorioz (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/720,160

(22) PCT Filed: May 10, 2000

(86) PCT No.: PCT/FR00/01248

§ 371 (c)(1),
(2), (4) Date: Jan. 3, 2001

(87) PCT Pub. No.: WO00/69532

PCT Pub. Date: Nov. 23, 2000

(30) Foreign Application Priority Data

May 12, 1999 (FR) ..... 99 06245

(51) Int. Cl.[7] ..... A63C 9/084
(52) U.S. Cl. ..... 280/626; 280/634
(58) Field of Search ..... 280/611, 617, 280/623, 625, 626, 631, 633, 634, 11.3, 11.31

(56) References Cited

U.S. PATENT DOCUMENTS

| | | | | | |
|---|---|---|---|---|---|
| 3,970,326 | A | * | 7/1976 | Salomon | 280/626 |
| 3,995,880 | A | * | 12/1976 | Murata | 280/626 |
| 4,035,001 | A | | 7/1977 | Jungkind | 280/626 |
| 4,113,277 | A | * | 9/1978 | Zoor | 280/626 |
| 4,140,332 | A | | 2/1979 | Beyl | 280/626 |
| 4,679,815 | A | * | 7/1987 | Pascal et al. | 280/633 |
| 4,863,186 | A | | 9/1989 | Rullier et al. | 280/626 |
| 4,915,405 | A | | 4/1990 | Rullier et al. | 280/634 |
| 4,915,407 | A | | 4/1990 | Brischoux | 280/626 |
| 5,316,331 | A | | 5/1994 | Gorza et al. | 280/618 |
| 5,738,364 | A | * | 4/1998 | Zotter et al. | 280/633 |

FOREIGN PATENT DOCUMENTS

| | | | | |
|---|---|---|---|---|
| DE | 2165314 | | 7/1973 | |
| DE | 35 27 143 | A1 * | 2/1987 | A63C/9/084 |
| DE | 19703955 | | 8/1998 | |
| EP | 0 324 341 | A2 * | 1/1989 | A63C/9/084 |
| EP | 0508241 | | 10/1992 | |
| EP | 0 887 092 | A1 * | 12/1998 | A63C/9/084 |
| FR | 2299883 | | 9/1976 | |
| FR | 2368973 | | 5/1978 | |
| FR | 2502019 | | 9/1982 | |
| FR | 2598928 | | 11/1987 | |
| FR | 2598934 | | 11/1987 | |

* cited by examiner

*Primary Examiner*—Frank Vanaman
(74) *Attorney, Agent, or Firm*—Greenblum & Bernstein, P.L.C.

(57) ABSTRACT

A binding for a boot on a gliding board, such as a ski. The binding includes a jaw connected to the ski via a first journalled connection with two curved side arms which are themselves journalled with respect to the ski about a journal axis. The first journal axis is located at the end of the upper arm portion of the curved side arms, such that the jaw is suspended downwardly with respect to the axis of the first journalled connection and the elastic mechanism is arranged beneath the such axis.

21 Claims, 6 Drawing Sheets

(partial cross-section A)

(cross-section A)

SUSPENDED HEEL-PIECE FOR THE SAFETY BINDING OF A SKI

BACKGROUND OF THE INVENTION

1. Field of the Invention

The present invention relates to a system for binding a boot on a gliding board, and more particularly a system to fix the rear end of the boot on the gliding board, for which the gliding board can be a ski or a snowboard.

2. Description of Background and Relevant Information

Various types of rear bindings for a boot on a ski, such as rear pivots, on the one hand, and heel-pieces, on the other hand, are known from specialized publications as well as commercially available products.

The rear pivots generally have a circular plate journalled along a vertical axis with respect to the plane of the ski, which receives an elastic release system itself journalled on the plate along a horizontal axis with respect to the plane of the ski due to lateral arms that connect the release system to the ski. One of the drawbacks of this type of binding is that, in the constructive versions mentioned in the French Patents No. 2368973, No. 2299883, and No. 2502019, there is a freedom of rotation of the release system about the vertical axis of the plate that does not favor the reinsertion of the binding. In the constructive version disclosed in the French Patent No. 2598934 which improves the conditions for reinsertion of the aforementioned bindings, there remains a drawback that this type of binding does not make it possible to absorb the forces generated by the bending of the ski. It has been noted that for the bindings described in these patents, some of the release values required by the safety standards are achieved with much difficulty, because these constructions do not make it possible to satisfactorily take into account the return forces due to the bending of the ski when the latter is taking point supports at the tip and tail.

Although heel-pieces, which are the most widely spread rear bindings, offer much interest in terms of comfort of use and safety (insertion, removal, adjustments), they however have a drawback related to skiing that lies in the fact that this type of binding must overcome the disadvantages due to its constructive mode by annexing a return device in order to take into account the return forces generated precisely by the bending of the ski when it is taking point supports at the tip and tail.

The positioning of this return device on a heel-piece then requires particular arrangements thereof, which somewhat complicate its construction and increase its manufacturing cost.

SUMMARY OF THE INVENTION

One of the objects of the invention is to propose a binding that is easy to insert and remove, but that does not require the addition of a particular mechanism to absorb the bendings of the ski when they generate variations in length between the abutment and the rear binding.

The device thus proposed by the invention aims at preserving the freedom of the ski at best due to more improved arrangements than those known from the prior pivots while conserving the qualities acknowledged in the heel-pieces.

Another object of the invention is to propose a binding in which the elastic release system comprises new structural arrangements that include only one elastic device ensuring both release and return functions, without requiring auxiliary elastic means as in the heel-pieces.

To this end, the safety binding of a boot on the ski according to the invention includes a body that is movable in a vertical and longitudinal plane with respect to the ski and comprises a jaw adapted to retain an end of the boot, this body being connected to the ski by two curved side arms by means of a first journal axis transverse to the ski, located at the end of the upper arm portion oriented toward the top of said curved arms, and of a second journal axis transverse to the ski affixed to the latter and cooperating, in the vicinity of the end of the boot beneath the level of the sole, with the end of the lower arm portion of the curved arms. Elastic means are housed in the body, adapted to return the jaw toward the ski, wherein the connection of the jaw body with the two curved side arms is constituted, for example, by the cooperation of a guiding pivot affixed to each of the curved side arms with a guiding ramp arranged on each of the lateral walls of the jaw body, wherein the guiding pivot also constitutes the journal axis of a maneuvering lever that can pivot in the zone of the upper end of the curved side arms, whereas the elastic energy means are arranged beneath the journal axis of the maneuvering lever, one of the ends of which is connected to the body of the jaw by another journalled axis, and wherein the lateral walls of the jaw body comprise a second ramp, a so-called "release ramp," in which cooperates a lug affixed to the curved side arms, located beneath the axis of the guiding pivots and enabling a release of the jaw body in the median vertical plane of the ski, when the user exerts an action on the other end of the maneuvering lever.

According to another embodiment of the binding according to the invention, the guiding ramp of the jaw body is inclined along a direction oriented from the front toward the rear and upwardly with respect to the plane of the ski when the jaw is in the inserted position. This particularly advantageous constructional arrangement makes it possible to absorb variations in length between the front abutment and the rear binding. Indeed, the displacement of the jaw body on the guiding pivots, due to the inclination of the guiding ramp, allows a substantial variation in the free spacing left for different boot sole lengths, but also when the bending of the ski tends to reduce this spacing on the boot during skiing.

According to another characteristic of the invention, the release ramp is constituted of a first portion whose general axis is arranged substantially parallel to the guiding ramp, and of a second portion forming a bend with the first portion, which bend constitutes the zone defining the release point of the jaw.

Finally, according to another alternative embodiment, the technical characteristics of the rear binding according to the invention can be improved due to a particular arrangement of the curved side arms, the surface of the lower arm portions of which, located across from the upper surface of the ski, comprises a profile diverging from the front toward the rear with respect to the surface of the ski extending over at least a portion of the length of the lower arm portions.

BRIEF DESCRIPTION OF THE DRAWINGS

The invention will be better understood from the description below, provided by way of a non-limiting example, with reference to the annexed drawings, in which.

DETAILED DESCRIPTION OF THE INVENTION

Because the binding according to the invention shown in the various drawing figures represents a new compromise between the rear pivots and the heel-pieces, it will be designated, hereinafter, as the "suspended heel-piece."

Figure 1:
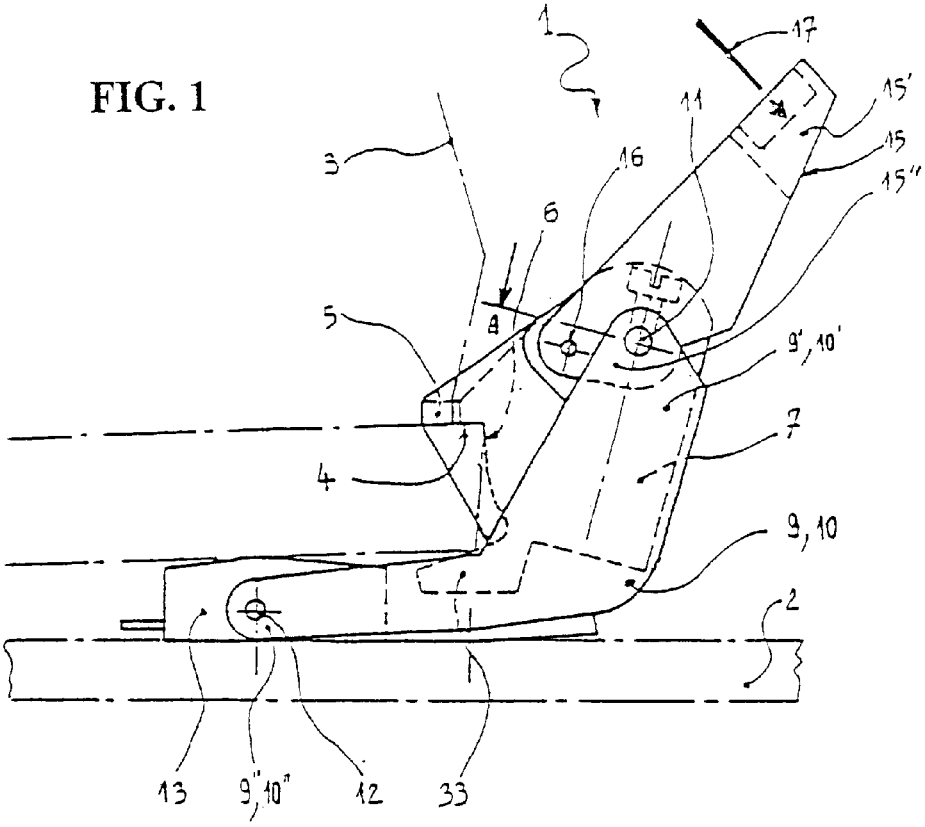
FIG. 1 shows a side view of a rear binding according to the invention, mounted on a ski in the so-called boot inserted position according to a particular construction mode for embodying the invention.

The suspended heel-piece 1 according to the invention shown in FIG. 1 is mounted on the upper surface of a ski 2. This suspended heel-piece 1 is adapted to retain the rear end of a boot 3 on the ski at the level of the upper edge of the sole 4 of the boot, on which the sole-clamp 5 of a jaw 6 takes support. This jaw 6 is constituted by a hollow body 7 housing the elastic energy mechanism 8 that returns the body of the jaw 6, 7 toward the ski, and which also enables the release of the body of the jaw 6, 7 to free the sole 4 of the boot when the forces exerted by the latter on the rear binding exceed a predetermined threshold beyond which the release of the boot is necessary to respect the user's safety.

The body of the jaw 6, 7 is connected to the ski via two curved side arms 9, 10 by means of a first journal axis 11 located at the upper end of the curved side arms 9, 10, on the one hand, and by means of a second journal axis 12 transverse to the ski and affixed thereto.

Furthermore, the axis 11 located at the upper end of the curved side arms 9, 10 serves as a journal axis for a maneuvering lever 15 that extends upwardly in the extension of the curved side arms. The maneuvering arm 15 is constituted by two lever arms 15' and 15" of different lengths determined by the position of the journal axis 11. The longest lever arm 15' constitutes the maneuvering member itself of the lever 15. The lever arm 15", shorter than the lever 15', for example in a 1–5 ratio, is connected at its end to the body of the jaw 6, 7 by a journalled driving axis 16. This driving axis 16 makes it possible to obtain the upward release of the body of the jaw 6, 7 when the maneuvering lever is pivotally actuated about the axis 11 under the effect of a force directed downward according to the direction of the arrow 17 shown in FIG. 1.

According to FIG. 1, the transverse axis 12 is arranged in a plate 13 which is itself affixed to the ski by binding means 14, such as screws. If necessary, this plate 13 comprises means for the lengthwise adjustment of the position of the rear binding according to the invention, which are mentioned hereinafter. The axis 12 is therefore located beneath the boot sole, in the zone of the rear end thereof.

Figure 2:
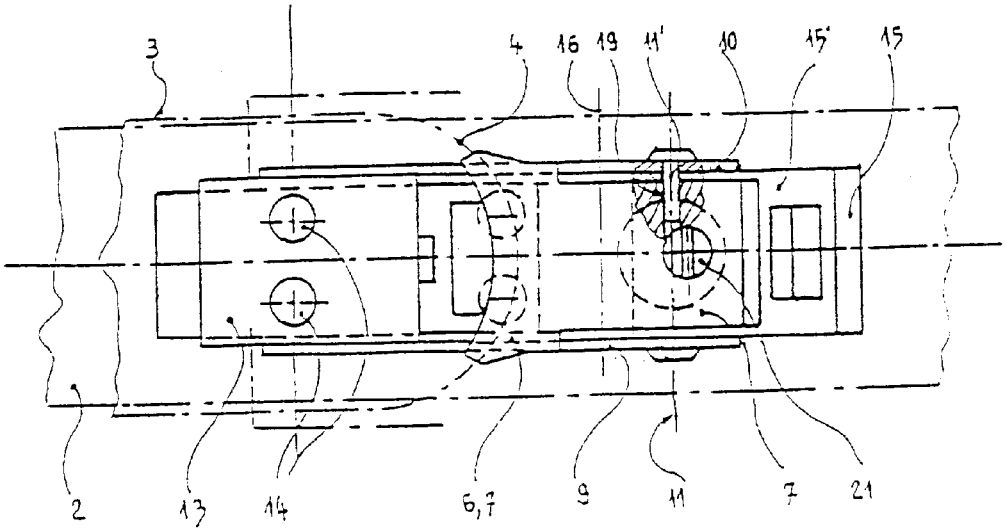
FIG. 2 shows a top view of the rear binding according to FIG. 1.

FIG. 2 enables one to note that the curved side arms 9, 10 are spaced apart along a shorter distance than the width of the sole 4. This distance advantageously corresponds to the width of the plate 13 that is housed between the arms.

Furthermore, in the case of the constructional arrangement envisioned, the journal axis 11 is obtained from two guiding pins or pivots 11', each mounted on the curved arms 9, 10 on each side of the binding, which extend freely through the maneuvering lever 15 to cooperate with a ramp 19 arranged in the rear upper zone of the body of the jaw 7.

Figure 3:
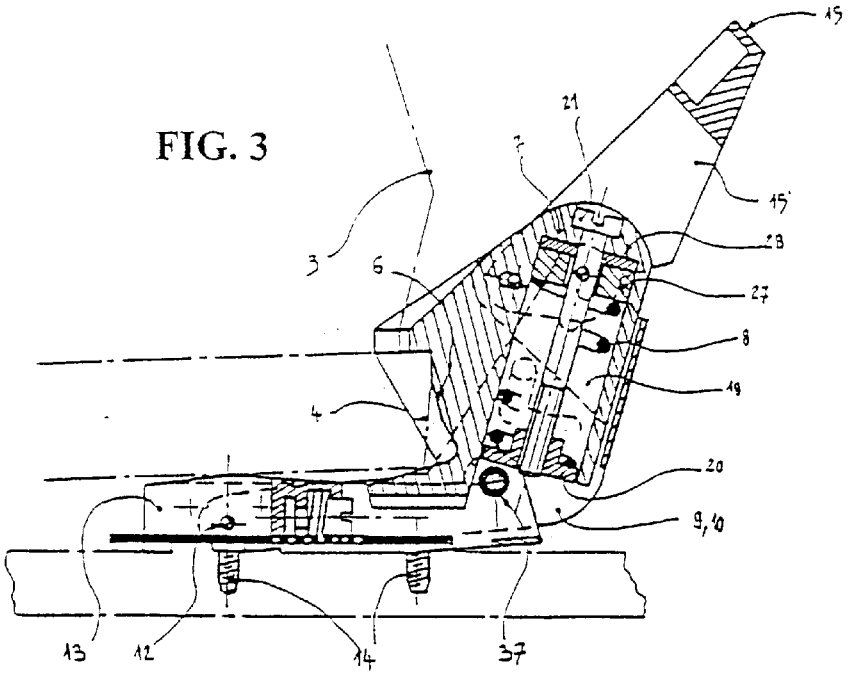
FIG. 3 shows a cross-sectional view of the binding according to FIG. 1.

FIG. 3 shows the suspended heel-piece according to the invention when the boot 3 is in the inserted position on the ski. The cross-sectional view makes it possible to note that the body of the jaw 7 is arranged with a housing 18 hollowed out in its mass, in which elastic energy mechanism 8 constituted by a spiral spring, for example, are inserted. This spring then takes support on the ends of each of the guiding pivots 11' whose length is provided to run into the housing 18 in the upper zone of the jaw body, whereas in the lower zone of the body of the jaw 7, a threaded cap 20 rotationally immobilized with respect to the body 7 maintains the other support surface of the spring compressed in the housing 18. The threaded cap 20 then plays the role of a nut for an adjusting screw 21 acting on the variation in the compression of the spring.

A distribution spacer 27 can be inserted between the spring 18 and the generating line of support for the guiding pivots 11' to better distribute the compressive forces on the pivots. Thus, the jaw is subject to a downward traction with respect to the curved side arms 9, 10.

Of course, the structure of the guiding pivots can be different from that described hereinabove, without leaving the scope of the invention. For example, rather than the pivots 11' being affixed to the curved arms, they can be affixed to the distribution spacer that is provided with two diametrically opposed pins freely cooperating in rotation with bearings provided in each of the curved side arms. In all cases, the distribution spacer 27 includes a passage hole making it possible to receive the adjusting screw 21 therein. Similarly, one can provide an elastic shock-absorbing washer 28 whose thickness at rest is greater than the free space left between the top of the distribution spacer 27 and the bottom of the housing 18 when the pivots have been pushed back, under the effect of the spring 8, toward the upper bottom of the guiding ramp 19.

The body of the jaw 7 is thus suspended at the upper end of the curved side arms 9, 10, such that this new type of binding does correspond to the aforementioned designation of suspended heel-pieces.

Furthermore, the main axis of the housing 18 is oriented substantially parallel to the direction of the upper arm portions 9', 10' of the curved arms 9, 10, inclined from the front toward the rear and toward the top of the ski along an acute angle, which selection can vary, for example, according to values ranging from 80° to 60°.

Figure 3A:
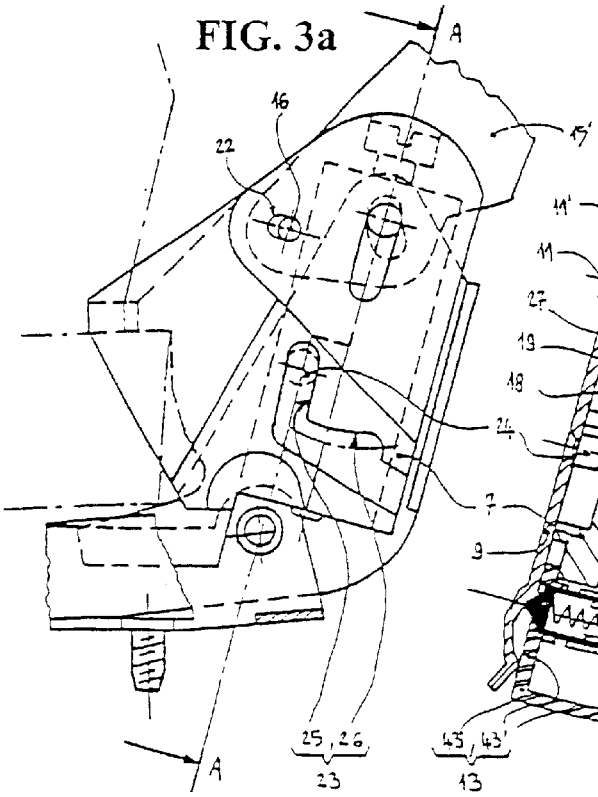
FIGS. 3*a* and 3*b* are enlarged partial cross-sectional side and front views, respectively, of the jaw of the binding according to FIG. 3.
Figure 3B:
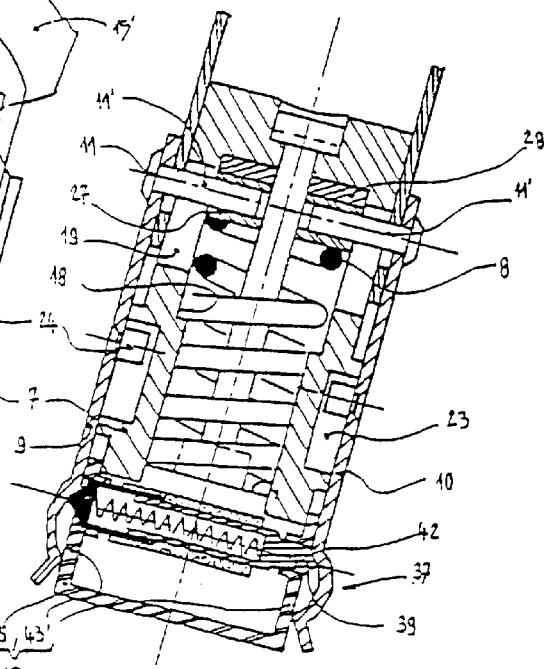

FIGS. 3*a* and 3*b* show enlarged design details of the body of the jaw 6, 7 as mounted in position according to FIG. 3. To this end, the jaw body is shown in a side view, right behind the surface of the curved side arm 9 so as to more clearly disclose the type of its constructive elements. Thus, each of the lateral sides of the body of the jaw 7 comprises, in its rear upper zone, a guiding ramp 19 hollowed out in the form of an elongated slot whose axis is advantageously parallel with that of the housing 18, and in which the guiding pivot 11', coming from each of the curved side arms 9, 10, cooperates. At a distance equal to that of the center distance determined by the journal axes 11 and 16, the wall of the jaw body comprises a second elongated slot 22 with which the journalled driving axis 16, coming from the end of the small lever arm 15" of the maneuvering lever 15, cooperates. This elongated slot 22 is oriented substantially perpendicular to the axis of the guiding ramp 19.

In addition to the guiding ramps 19, the jaw body comprises a so-called release ramp 23, also arranged on each of its sides, which is adapted to cooperate with a lug 24 affixed to the curved side arm 9, 10. Advantageously, this release ramp 23 is bored in the wall of the body of the jaw 7, such that the lug 24 can easily be housed therein without creating any excessive thickness. This release ramp is constituted by two portions, one of which is a substantially rectilinear portion 25, called a "retraction ramp" oriented parallel to the guiding ramp 19, and the other of which is a curved portion called escape ramp 26 forming a bend with the retraction ramp 25 while being oriented toward the rear of the jaw body. The release ramp 23 thus obtained is constituted of a combination of two successive ramps, the retraction ramp 25 and the escape ramp 26, preferably localized in the lower zone of the jaw body so as to ensure that the release movement of the latter is properly directed during releases of the suspended heel-piece subject to a bias of opening forces.

In the embodiment shown in FIG. 3*a*, the curve of the escape ramp 26 is preferably centered at a point close to the journal axis 11, in a zone located to the left of the latter, so as to cause a slight decompression of the spring 8 when the lug 24 has gone past the so-called release point defined by the bend between the two ramps 25 and 26.

In this regard, it should be noted that the profile of the release ramp 23 is not limited to that described hereinabove. Indeed, the median axis of the retraction ramp 25 and the median axis of the escape ramp can also form therebetween a different 90° angle whose vertex determines the spring release point.

The release point is determined by the intersection of the two ramps 25 and 26, and corresponds to the vertex of the angle formed by the two portions of the release ramp 23, which is directed toward the front of the ski.

Figure 8:
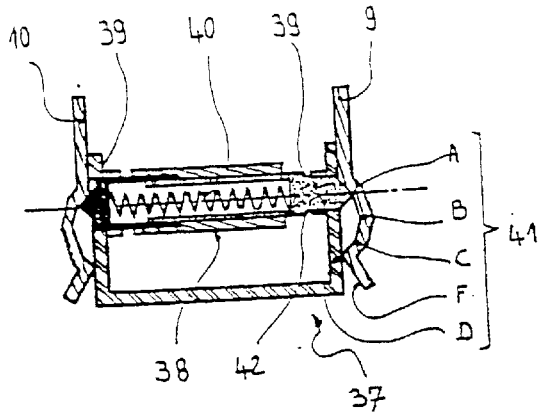
FIG. 8 also shows a partial cross-sectional view of a detail of the binding according to FIG. 3, which relates to a device for retaining and stabilizing the curved side arms in the vicinity of the ski.

FIG. 3*b* further shows a particularly interesting additional arrangement for the suspended heel-piece according to the invention, which is developed in more detail with reference to FIG. 8.

Indeed, the assembly of the curved side arms 9, 10 that carries the jaw 6, 7 pivots freely about the journal axis 12. This has the advantage of being capable of tilting the suspended heel-piece completely from the rear toward the front of the ski, thus clearing the access to the binding means 14 located at the rear of the adjusting slide supporting the plate 13.

However, this advantage can prove undesirable, especially during transportation of the skis whose suspended heel-pieces can be caused to pivot without retention about the journal axis 12.

To mitigate this undesirable effect, the rear lower zone of each of the curved side arms 9, 10 has been provided with a device 37 for the elastic stabilization of the curved arms with respect to the ski, which facilitates the return to the position before insertion of the heel-piece on the ski.

To this end, the elastic stabilizing device 37 is constituted of an elastic piston 38 having two conical end-pieces 39 spaced apart by means of a spring 40, and of a positioning dome 41 arranged on the inner walls of each of the curved side arms 9, 10.

The elastic piston 38 is mounted transversely with respect to the longitudinal axis of the ski in a boring 42 provided in the rear extension of the body of the plate 13. The two conical end-pieces 39 overlap the plate to cooperate with either of the points A, B, C, or D of the positioning dome 41.

Figure 4:
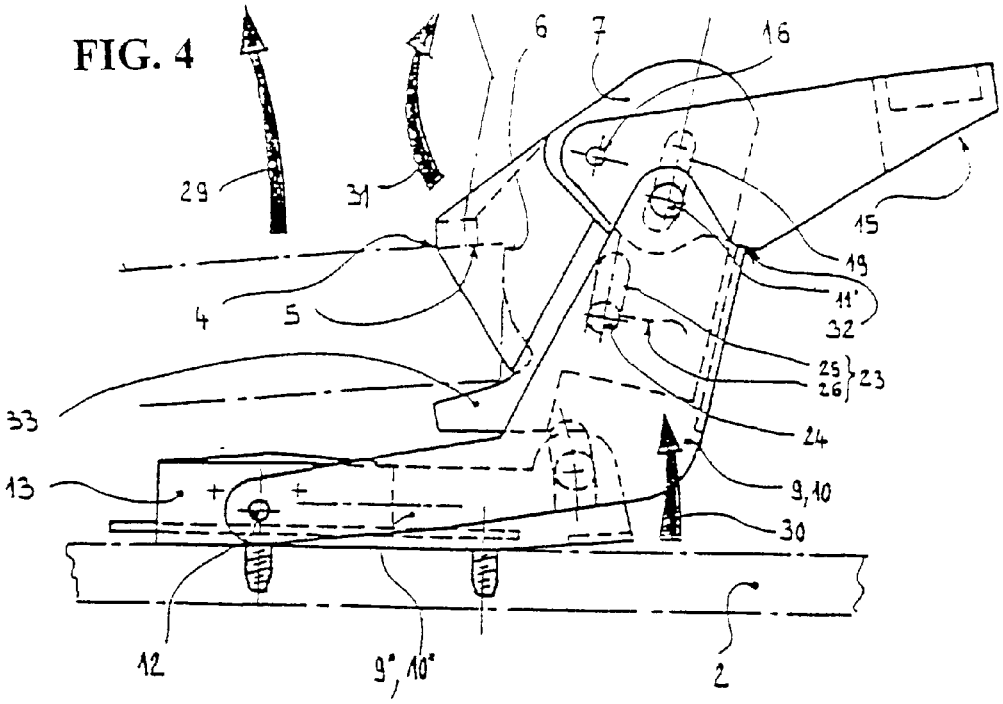
FIG. 4 shows the binding according to the invention shown in the so-called boot released position, when the boot is released under the effect of a force greater than that of the force for retaining the boot.
Figure 5:
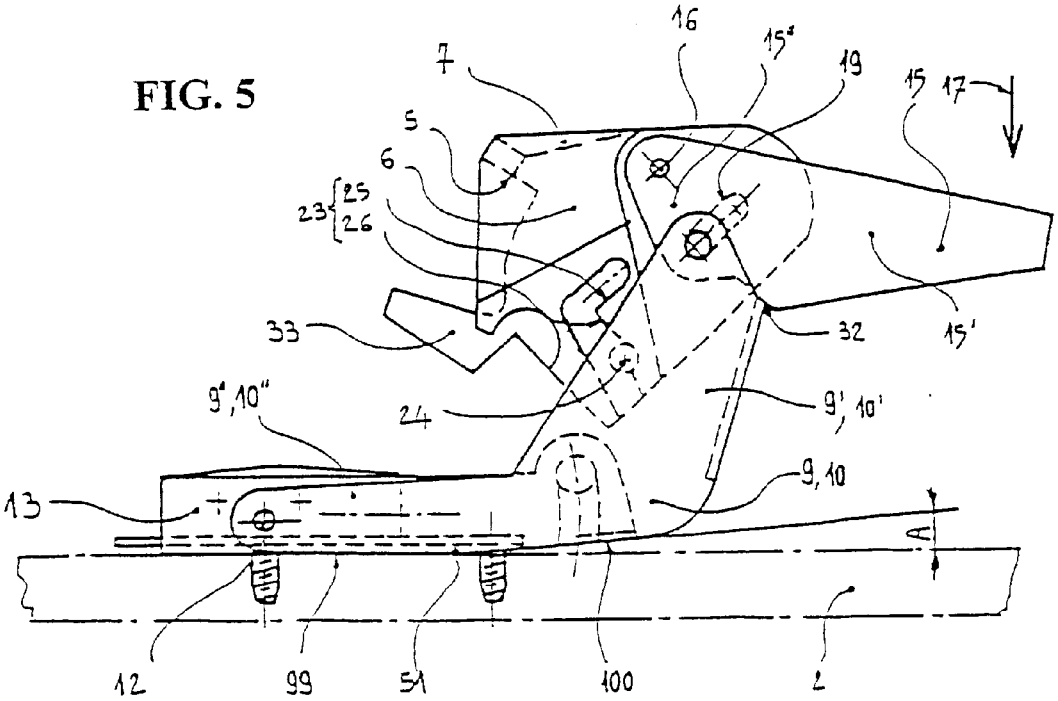
FIG. 5 shows the binding according to the invention in the so-called opening position under the effect of a force exerted on its maneuvering lever.

Each of the positioning domes 41 is configured by a succession of inclined planes whose intersection constitutes:

point 41A, equivalent to a position of the heel-piece during insertion, corresponding to the binding according to FIG. 5;

point 41B, equivalent to a stable position of the heel-piece when it is in position, at rest without bias, corresponding to the position of the binding according to FIG. 1;

point 41C, equivalent to a release position of the heel-piece, corresponding to the position of the binding according to FIG. 4;

point 41D, equivalent to a complete release of the heel-piece about its axis 12. The funnel shape of the inclined plane 41F then makes it possible to reengage the elastic stabilizing device 37 in the position 41A or 41B, if necessary, by mere pressure on the heel-piece assembly.

FIG. 4 shows the suspended heel-piece according to the invention when the binding is subject to a release force due to an ill-timed bias of the boot during skiing, indicated by the arrow 29, whose value is greater than the preadjusted release value of the binding. At this moment, the body of the jaw 6, 7 moves upwardly along a trajectory defined by the retraction ramp 25 cooperating with the lug 24, simultaneously and in combination with the cooperation of the guiding ramp 19 with the guiding pivots 11', the whole under the effect of the elastic element 8 that is still compressed; as a result, the assembly of the two curved side arms 9, 10 performs a rotation about the journal axis 12 by moving away from the surface of the ski, according to a movement shown by the arrow 30. When the lug 24 reaches the bend formed by the retraction ramp 25 and the escape ramp 26 to overlap the bend that constitutes the release point of the jaw 6, 7, the latter, still under the effect of the spring 8, at the very moment when the release point is reached, tilts upwardly along a rotational movement centered on the axis 11 of the guiding pivots 11', as indicated by the arrow 31, and causes the opening of the binding that has the effect of completely releasing the boot. The rear binding according to the invention is then in a so-called insertion position shown in particular in FIG. 5 of the present document.

Of course, the suspended heel-piece can also be maneuvered to perform a voluntary removal of the boot. In this case, by a voluntary action of the skier exerting a thrust (indicated by the arrow 17 in FIG. 1 or 5) in the zone 15' of the maneuvering lever 15, the latter generates a rotation of the maneuvering lever 15 about the axis 11 of the pivots 11' which slide in the guiding ramp 19 arranged in each of the lateral walls of the jaw 6, 7 and compress the spring 8. Simultaneously and under the effect of the thrust 17, the assembly of the curved side arms 9, 10 also comes in support on the ski, at the level of the lower arm portions 9", 10" of each of the side arms; the jaw 6, 7 then moves according to the same process as previously described during a release due to an ill-timed bias of the boot while skiing. Since the compression of the spring 8 is maximum at the time when the lug 24 reaches the bend formed between the two ramps 25 and 26 of the release ramp 23, the profile of the escape ramp 26 slightly decompresses the spring 8 so as to cause the jaw 6, 7 to open to the maximum under the effect of the latter. To improve the conditions under which the jaw 6, 7 opens, the maneuvering lever 15 is designed to take support on a lift abutment 32 arranged on the rear of the assembly of the curved side arms 9, 10 at the level of the upper portion of the upper arm portions 9', 10'. This support is obtained under the effect of the maximum compression of the spring 8 when the maneuvering lever 15 is actuated and thereby causes a change in the ratio between the lever arms 15' and 15", which then shifts from 1 to 2 for the lever arm 15" that extends from the lift abutment 32 to the axis 16, and for the lever arm 15' that extends from the abutment 32 to the end of the maneuvering lever where the opening force is applied. This change in the value of the lever arms 15' and 15" allows a low amplitude rearward tilting of the lever 15 promoting the complete opening of the jaw, if necessary.

As is the case after an ill-timed opening, the heel-piece is thus in the so-called insertion position shown in FIG. 5, ready to be reinserted.

To this end, the sole of the boot 3 takes support on the insertion pedal 33 that is an integral part of the jaw 6, 7 (FIG. 5).

The insertion force applied on this pedal 33 causes the assembly of the curved side arms 9, 10 to pivot downwardly about the axis 12, such that this assembly takes support via the lower arm portions 9", 10" on the upper surface of the ski. Simultaneously to this pivoting movement of the curved side arms, the body of the jaw 6, 7 pivots about the axis 11 of the guiding pivots 11'; this pivoting movement causes the escape ramp 26 to displace on each of the lugs 24 affixed to the curved side arms until the lugs arrive in the retraction ramp 25; at this moment, the spring 8 slackens partially and causes the downward displacement of the body of the jaw 6, 7 along the trajectory, defined concurrently by the profile of the ramp 25 with the lug 24 and the guiding ramp 19 with the guiding pivots 11' until blocking the sole 4 of the boot between the sole-clamp 5 and the plate 13 to find again the position of the inserted binding, as shown in FIG. 1 or 3.

Figure 6:
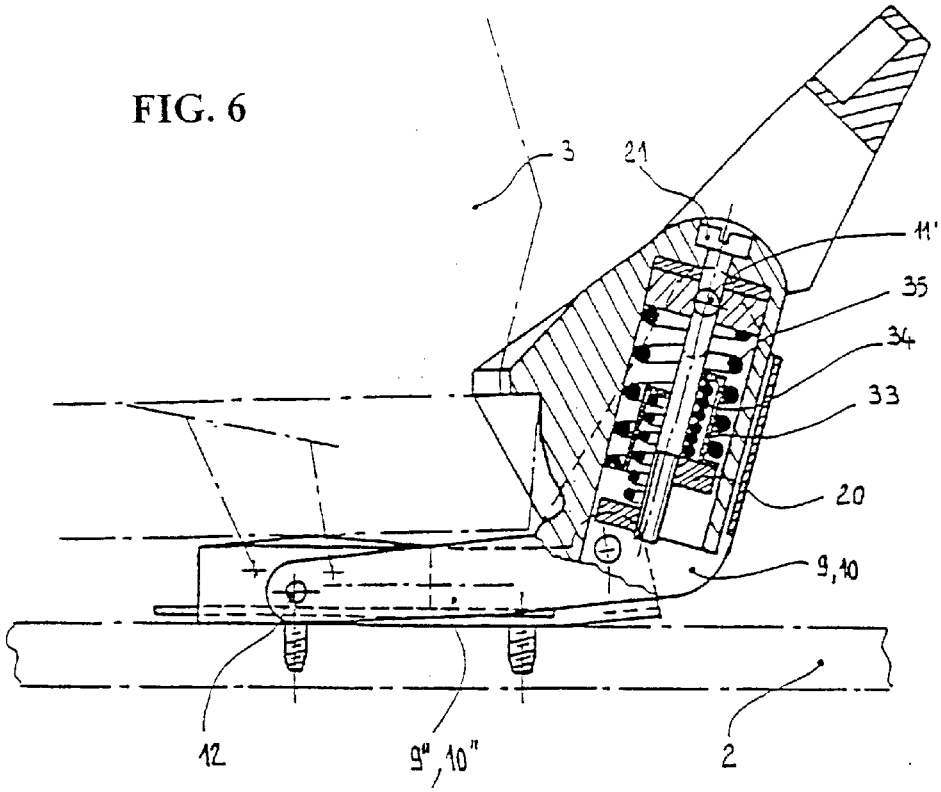
FIG. 6 shows a partial cross-sectional view of a binding according to the invention mounted on the ski in the so-called boot inserted position, whose embodiment comprises elastic energy mechanism constituted by two springs arranged coaxially.

The construction shown in FIG. 6 represents a suspended heel-piece according to the invention, in which the elastic energy mechanism is advantageously constituted by two compression springs 34 and 35 mounted in series in the housing 18 arranged in the body of the jaw 6, 7. To this end, one of the springs, called the inner spring 34, is freely nested in the second spring, called the outer spring 35, on at least a portion of their respective length. A separating spacer 33 retains each of the two springs respectively in support one against the other, on the one hand, and against the guiding pivots 11' for one, and against the nut 20 for the other. This construction has the advantage of procuring a spring characteristic that can restore substantial compression distances, although it is arranged in a housing whose length for housing a compression spring is reduced. Furthermore, it is possible to obtain, with this construction, a very wide release adjustment range while keeping a substantial spring force at the adjustment point of the minimum hardness of the heel-piece.

Figure 7:
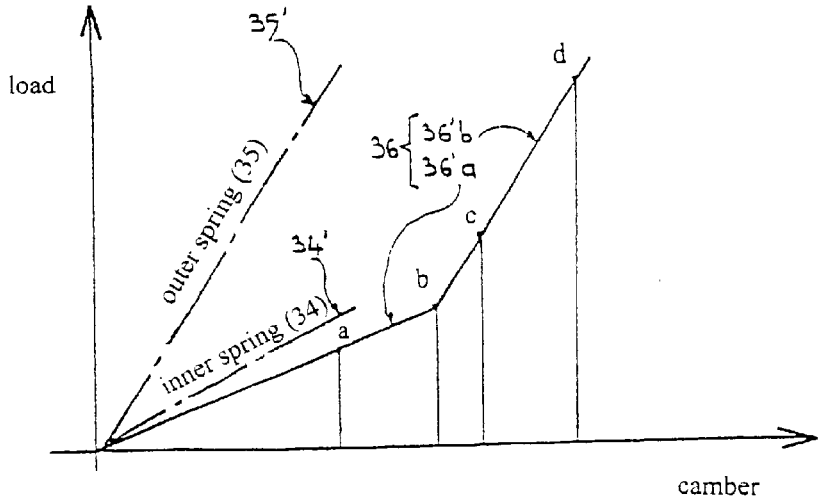
FIG. 7 shows a chart of the forces to which each of the springs is subject as a function of its camber in the course of constructing the binding according to FIG. 6.

The diagram of FIG. 7 discloses the advantage of this constructional arrangement.

The diagram shows several types of straight lines which represent, respectively:

- the curve 35' of the compressive forces (load) as a function of the compression distance (camber) imposed during a bias in the case of the spring 35, if it were mounted alone in the binding;
- the curve 34' in the case of the spring 34, if it were mounted alone in the binding;
- the curve 36' (broken straight line) induced in the case of the serial mounting of the springs 34, 35.

Considering this broken straight line 36', the latter corresponds to a situation of the state of the springs present for various points of adjustment of the hardness of the heel-piece. The point (a) indicated on the straight line portion 36' corresponds to a predetermined adjustment of minimum hardness to which a release force, indicated by the point (b) of the same straight line portion 36'*a*, corresponds; similarly, the point (c) indicated on the straight line portion 36'*b* corresponds to a predetermined adjustment of maximum hardness to which a release force, indicated by the point (d) of the same straight line portion 36'*b*, corresponds. In this spring configuration shown, one obtains advantageously that the points (b) and (d) are located on the same straight line portion 36'*b*, for example. One thus obtains a better distribution of the adjustment values of the heel-piece.

Figure 9B:
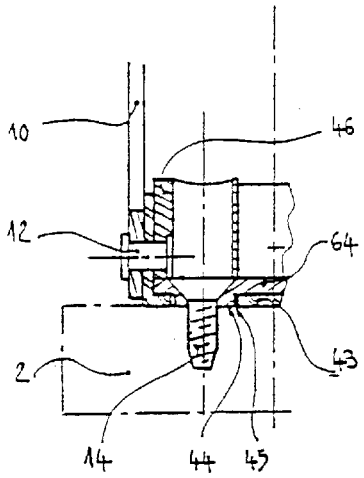
FIGS. 9*a*, 9*b*, and 9*c* show a partial lateral cross-sectional view, a cross-sectional side view, and a top view, respectively, of a portion of the length adjusting device of the rear binding according to the invention.
Figure 9A:
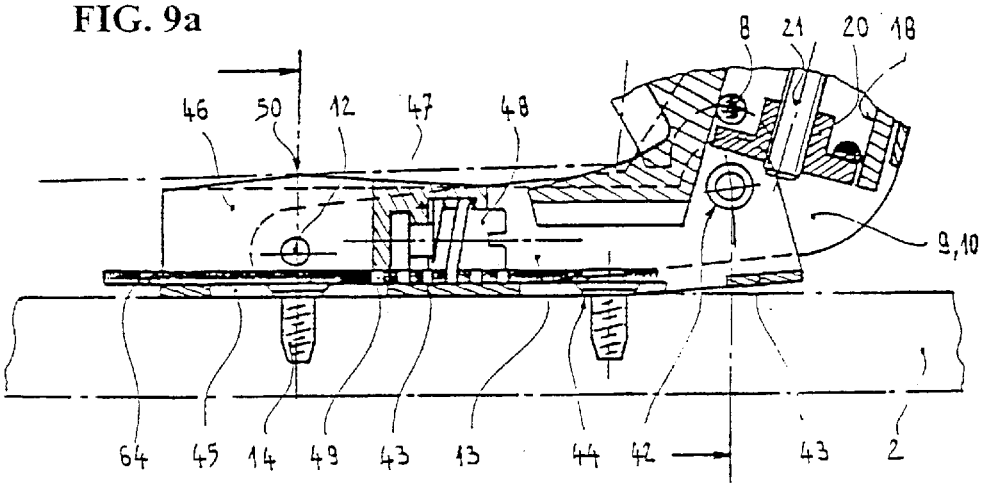
Figure 9C:
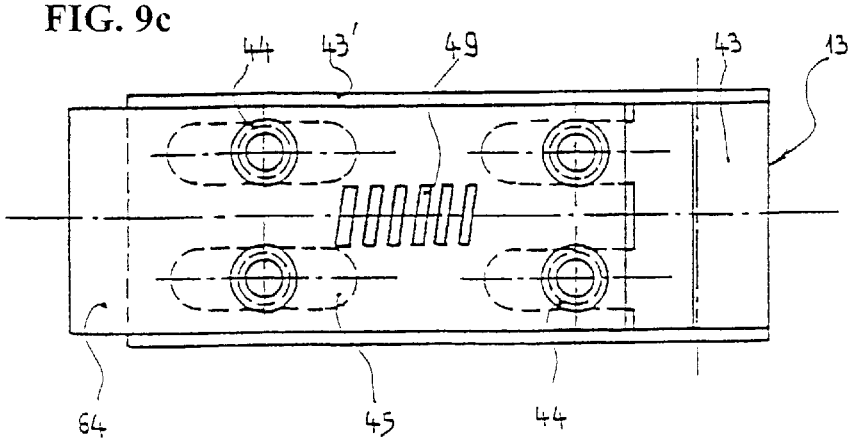

FIGS. 9*a*, 9*b*, and 9*c* show an alternative embodiment of the connection of the second journal axis 12 of the suspended heel-piece with the ski 2. In this alternative construction, the axis 12 is adjustably affixed to the ski by means of a notched slide 64 fixed on the ski by the screws 14. In a known fashion, this slide 64 comprises support bosses 44 through which the screws 14 pass. The height of the support bosses determines a clearance between the slide and the upper surface of the ski, which makes it possible to insert the bottom 43 of the plate 13 therein. The plate 13 in the exemplary case shown is generally U-shaped, the bottom 43 comprises sliding slots 45 whose width corresponds to the diameter of each of the support bosses 44. The length of these sliding slots 45 determines the allowed trajectory of the plate 13 with respect to the slide 64. The two lateral walls 43' of the U-shaped plate receive the journal axis 12 with which the end of the lower arm portions 9", 10" of each of the curved side arms cooperates rotationally. A foot-rest cover 46 is inserted between the lateral wall 43' of the plate 13 to which it is advantageously affixed via the journal axis 12. This foot-rest cover 46 comprises an inner cage 47 which makes it possible to receive an adjusting screw 48 whose worm screw portion cooperates with the notches 49 of the notched slide 64. The maneuver of this screw causes a displacement of the suspended heel-piece assembly with respect to the notched slide 64 and, therefore, with respect to the ski. Advantageously, the portion of the foot-rest cover 46 adapted to come in contact with the boot sole is constituted by the edge of a dihedron 50, transverse with respect to the longitudinal axis. According to another variation, not shown but which can be easily embodied, this edge 50 is constituted by the generating line of a cylindrical surface. The advantage of this constructional arrangement is to increase the ability to absorb the variations in length generated by the bending movements of the ski due to the interdependency of the effects of certain constructional characteristics of the lower arm portions 9", 10" of each of the curved side arms 9, 10. It is noted in this regard, and for the same reasons, that the rear extension of the body of the plate 13 that receives a portion of the elastic stabilizing device 37 is also provided with a U-shaped structure whose bottom 43 is distanced from the plane of the ski along a predetermined angle A.

Figure 10:
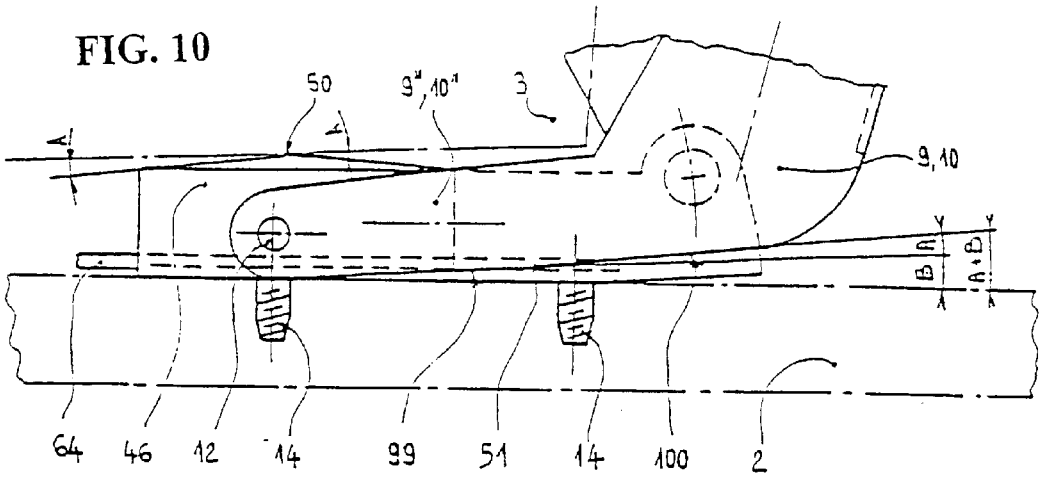
FIG. 10 shows a partial lateral view of the constructional detail of the lower arm portion of one of the curved side arms of the binding according to the invention.

FIG. 10 shows the detail of the profile of each of the lower arm portions 9", 10" of the curved side arms 9, 10. As has been mentioned previously, the principle of the suspended heel-piece according to the invention has been developed to meet the need to allow the ski or gliding board to bend as freely as possible with respect to the boot. To this end, the advantages of the suspended heel-piece already described are further amplified, when according to a characteristic related to the invention, the profile of the lower arm portions 9", 10" of the curved side arms coming in support on the upper surface of the ski when the latter is subject to bendings, meets certain criteria of construction. It is provided that the rectilinear front portion 99 of the profile of the lower arm portions 9", 10", which normally rests on the upper surface of the ski when the suspended heel-piece is in the reinsertion position (FIG. 5), extend advantageously up to a point of inflexion 51 located approximately perpendicular to the insertion pedal 32. Beyond the point of inflexion 51, the rear portion 100 of the profile in question is constituted by a rectilinear portion forming an angle A with the plane of the ski (still when the suspended heel-piece is in its reinsertion position according to FIG. 5), and continues with a rounding toward the upper arm portion 9', 10' of the curved side arms.

When the boot is mounted on the ski, between a front binding known per se and the suspended heel-piece according to the invention, the front portion of the profile 99 of the lower arm portions 9", 10" defines an angle B with respect to the plane of the ski. This angle B provides the measurement of the ski bending amplitude, without the bootbinding assembly being affected by the bending. Due to this angular clearance A attributed by construction to the rear portion of the profile 100 of the lower arm portions 9", 10", this amplitude can further increase up to the value (A+B) to absorb substantial variations in bending, without the latter influencing the release values of the binding. It is noted in passing that the arrangement of the angle B formed by the front portion 99 of the profile of the lower arms 9", 10" with the plane of the ski not only enables the aforementioned improvement during bending of the ski, but also makes it possible to absorb a snow wedge between the sole 4 and the foot-rest cover 46 of the plate 13, because the front portion 99 of the profile of the lower arm portions, which comes in support with the plane of the ski, limits the rearward tilting of the curved side arms 9, 10 by maintaining the maximum gripping height capacity (sole+snow wedge) subject to the tightening of the jaw.

Furthermore, the dihedral structure of the foot-rest cover 46 or 56 further improves the ski bending absorption conditions in that each of the planes of the dihedron forms an angle A with respect to the plane of the boot sole, which allows an angular movement of the dihedron involved with respect to the plane of the sole 4 without disturbing the latter.

Figure 11A:
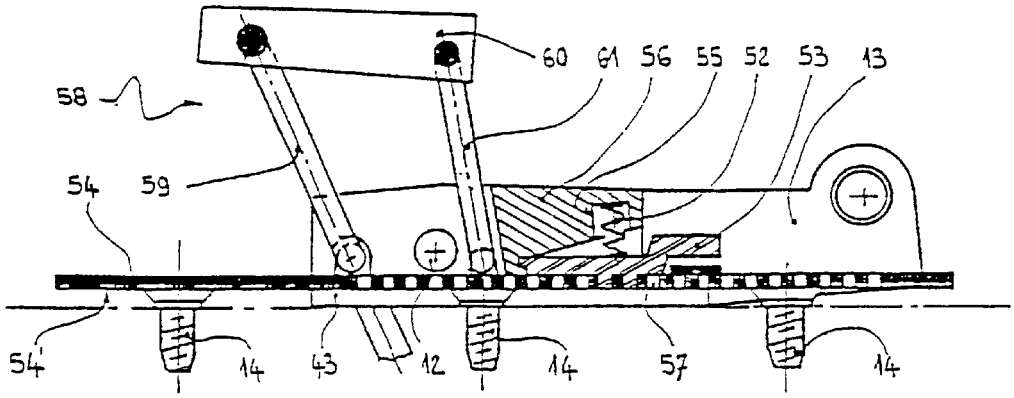
FIGS. 11*a* and 11*b* show a lateral cross-section and a top view, respectively, of an alternative construction of a length adjusting device housed between the curved side arms of the binding comprising a ski brake integrated into its structure.
Figure 11B:
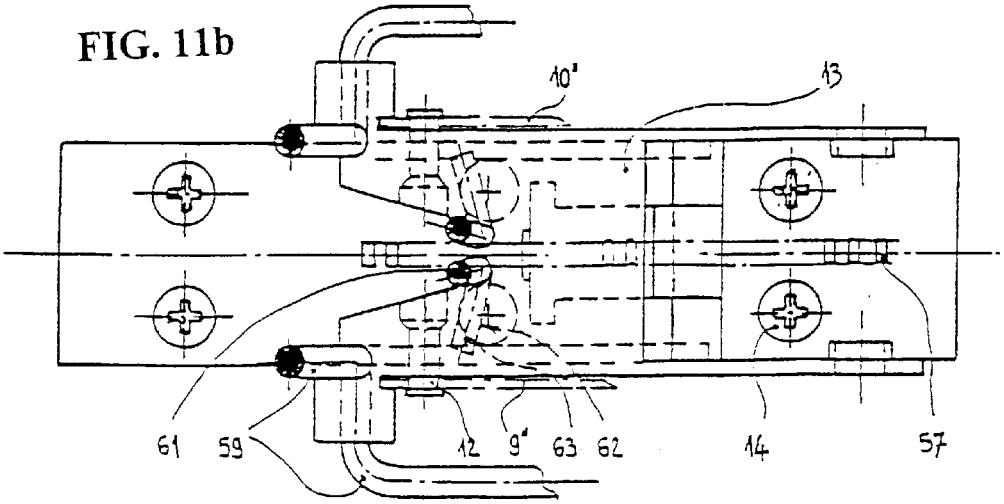

FIGS. 11*a* and 11*b* show a longitudinal and top cross-section of an alternative embodiment of the adjustable plate. This variation shows a notched slide provided to be lengthy, for a so-called locating binding that is capable of accepting several lengths of boot sizes.

To this end, the notched slide 54 is advantageously made in a hard, but thin and flexible material, so that it can deform and return to its initial position during a succession of bendings of the ski.

In this type of construction, the adjusting screw has been replaced by a toothed latch 53 subject to a spring 52 taking support in a housing 55 provided for this purpose in the foot-rest cover 56 of the plate 13. This spring 52 applies the toothed latch 53 in the notches 57 of the notched slide 54 for a desired adjustment in length of the position of the plate 13 on the slide 54 and, therefore, for a corresponding adjustment in length of the journal axis 12 of the suspended heel-piece. Another advantage of this constructional arrangement lies in the fact that the foot-rest cover 56 affixed to the plate 13 at the level of the journal axis 12 can also serve as a bearing unit for mounting a ski brake 58 of a known type constituted of two lateral spades 59 connected to an actuating plate 60, the whole being energized by a twisting buckle 61 affixed to the plate via two bearings 62 arranged in the latter and in which the two returns 63 of the twisting buckle 61 rotate.

The originality of the construction is due not only to the fact that the ski brake is subject to the same length adjustment as the suspended heel-piece itself, but also to the fact that the operational play of the adjusting device assembly is immobilized efficiently by the action of inserting the boot that acts directly on the support plate 60 of the ski brake. Indeed, the insertion force on the support plate 60 of the ski brake causes a frontward rotation of the twisting buckle 61, about each of the bearings 62 where the two buckle returns 63 are maintained against the upper surface of the slide 54. Because of the angle formed between each of the buckle returns 63 and each of the strands of the buckle 61, an upward vertical force is generated which tends to flatten the bottom 43 of the plate 13 against the lower surface 54' of the slide 54.

Other variations of this type of construction can be envisioned without leaving the scope of the invention, for which the suspended heel-piece assembly provided with a ski brake is adjustable in length. Similarly, the present description relative to any particular embodiment of the binding according to the invention is provided for guidance only, and other embodiments could be adopted without leaving the scope thereof.

What is claimed is:

1. A binding for releasably retaining a boot to a gliding board by retaining an end of the boot to the gliding board, said binding comprising:

a body movable in a vertical and longitudinal plane with respect to the gliding board, said body comprising a jaw adapted to retain the end of the boot, said body to be connected to the gliding board by two curved side arms by means of a first journal extending along a first axis transverse to the gliding board, located at an end of an upper arm portion of said curved arms, and of a second journal extending along a second axis transverse to the gliding board, cooperating affixedly with the ski in the vicinity of an end of the boot beneath a sole of the boot and with a front end of a lower arm portion of said curved arms;

an elastic mechanism adapted to return said jaw toward a surface of the gliding board, said elastic mechanism being housed in said body of the jaw, wherein the connection of said body of the jaw with each of said two curved side arms is constituted by a guiding pivot cooperating with a guiding ramp, wherein said guiding pivot and said guiding ramp are arranged across from each other on either said body of the jaw or said curved side arms;

a maneuvering lever journalled about an axis of said guiding pivot for moving said jaw from a boot inserted position to a boot released position, said maneuvering lever having at least two ends, a first of said two ends of said maneuvering lever cooperating with said body of the jaw by another journal, a second of said two ends of said maneuvering lever being subject to a downward thrust, causing an upward movement of said jaw to said boot released position, said elastic mechanism being arranged beneath said axis of said guiding pivot of said maneuvering lever;

said jaw having opposite lateral walls cooperating with respective ones of said curved side arms during movement of said maneuvering lever, whereby each of said lateral walls of said jaw includes a release ramp or a release lug and each of said curved side arms includes a release ramp or a release lug, each of said release lugs being guided by a respective one of said release ramps, said release lugs being arranged beneath said axis of said guiding pivot of said maneuvering lever.

2. A binding according to claim 1, wherein in the boot inserted position, each said guiding ramp of said body of the jaw is inclined in a direction extending rearwardly and upwardly.

3. A binding according to claim 1, wherein said elastic mechanism is constituted by at least one compression spring, said compression spring having a compression axis perpendicular to the journal axis of said maneuvering lever, said compression spring being inclined in a direction extending rearwardly and upwardly.

4. A binding according to claim 1, wherein said elastic mechanism is constituted by two compression springs having different characteristics, said two compression springs being mounted in series, one of said two compression springs being partially within the other of said two compression springs.

5. A binding according to claim 1, wherein each said release ramp is constituted by two substantially longitudinal portions forming therebetween an angle having a forwardly directed vertex.

6. A binding according to claim 5, wherein one of said two longitudinal portions of each said release ramp is a substantially rectilinear portion constituting a retraction ramp, said retraction ramp being parallel with said guiding ramp, and a second of said two longitudinal portions of each said release ramp is a curved portion constituting an escape ramp, said escape ramp being oriented toward a rear of said jaw.

7. A binding according to claim 6, wherein said escape ramp comprising a curve centered at a point in front of and close to the journal axis said maneuvering lever.

8. A binding according to claim 1, wherein a respective one of said guiding ramps is arranged in each of said lateral walls of said jaw and cooperates with one of said guiding pivots affixed to a respective one of said curved side arms.

9. A binding according to claim 1, wherein a respective one of said guiding ramps is arranged in each of said lateral walls of said jaw and cooperates with one of said guiding pivots movable translationally in said body of the jaw under the effect of said elastic mechanism and movable rotationally with respect to each of said curved side arms.

10. A binding according to claim 1, wherein a respective one of said release ramps is arranged in each of said lateral walls of a lower zone of said jaw and cooperates with one of said release lugs affixed to each of said curved side arms.

11. A binding according to claim 1, wherein said jaw further comprises an insertion pedal adapted to be engaged by the boot, and wherein each of said curved side arms comprises a lower arm portion positioned to face an upper surface of the gliding board, each of said lower arm portions comprising a point of inflexion located approximately perpendicular to said insertion pedal of said jaw, each of said lower arm portions extending from said point of inflexion along a rectilinear portion forming an angle A with a plane of said gliding board.

12. A binding according to claim 11, wherein in said boot inserted position of said jaw, each of said lower arm portions of said curved side arms includes a front arm portion, extending up to said point of inflexion, forming an angle B.

13. A binding according to claim 1, further comprising a translational adjustment mechanism for said second journal, whereby said second journal, by which said curved arms are to be journalled to the gliding board, is adjustable translationally with respect to the gliding board.

14. A binding according to claim 13, wherein said translational adjustment mechanism for said second journal comprises a generally U-shaped plate movable translationally with respect to the gliding board has a width equal to a free space between said curved side arms.

15. A binding according to claim 14, wherein the rear of the plate comprises a device for elastic stabilization of said curved arms with respect to a plane of the gliding board, said device comprising an elastic piston with two end-pieces each cooperating with a positioning dome arranged at a bottom of each of said curved side arms.

16. A binding according to claim 14, wherein said plate also receives a foot-rest cover having a support zone for the boot sole constituted by an edge of a dihedron transverse to said longitudinal plane.

17. A binding according to claim 16, wherein said dihedron includes planes forming an angle A with respect to a plane of the sole of the boot.

18. A binding according to claim 14, wherein said plate also receives a footrest cover, bearings adapted to receive a ski brake are arranged beneath said foot-rest cover.

19. A binding according to claim 18, wherein said translational adjustment mechanism for said second journal further comprises a slide with respect to which said plate is adjustably affixed, and wherein said bearings for the ski brake are constructed to receive returns of an energy buckle of the ski brake, said bearings being constituted by a recess in walls of said plate to maintain said buckle returns against an upper surface of said slide.

20. A binding according to claim 18 in combination with said ski brake.

21. A binding according to claim 1, wherein said gliding board is a ski and said binding is a heel binding.

* * * * *